US006527122B1

(12) United States Patent
Taylor et al.

(10) Patent No.: US 6,527,122 B1
(45) Date of Patent: Mar. 4, 2003

(54) STACKABLE DISPLAY BINS WITH REMOVABLE PIVOTAL DOORS

(75) Inventors: Curtis P. Taylor, Moreland Hills, OH (US); Anthony V. Sainato, Mayfield Heights, OH (US)

(73) Assignee: Bintek, LLC, Chagrin Falls, OH (US)

( * ) Notice: Subject to any disclaimer, the term of this patent is extended or adjusted under 35 U.S.C. 154(b) by 45 days.

(21) Appl. No.: 09/812,052

(22) Filed: Mar. 19, 2001

(51) Int. Cl.[7] ..... B65D 6/00
(52) U.S. Cl. ..... 206/509; 220/23.83; 220/608
(58) Field of Search ..... 206/509, 503; 220/23.83, 23.86, 608

(56) References Cited

U.S. PATENT DOCUMENTS

| | | | | |
|---|---|---|---|---|
| D30,426 | S | 3/1899 | Meyer | |
| D49,497 | S | 8/1916 | Walker, Jr. | |
| D49,501 | S | 8/1916 | Walker, Jr. | |
| D89,950 | S | 5/1933 | Duncan | |
| 2,295,313 | A | 9/1942 | Weir | 221/92 |
| 2,463,658 | A | 3/1949 | Thrasher | 62/89.5 |
| D159,884 | S | 9/1950 | Baldanza | D19/92 |
| 2,556,927 | A | 6/1951 | Langel et al. | 220/4 |
| 2,677,483 | A | 5/1954 | Shaw | 206/509 |
| 2,811,404 | A | 10/1957 | Brooks et al. | 312/122 |
| 3,107,131 | A | 10/1963 | Lightburn | 312/107 |
| 3,478,892 | A | 11/1969 | Lockwood | 211/126 |
| 4,056,295 | A | 11/1977 | Downing | 312/107 |
| 4,093,071 | A | 6/1978 | Stahl et al. | 206/507 |
| 4,176,747 | A | 12/1979 | Aho | 206/509 |
| D255,627 | S | 7/1980 | Newsom, Jr. et al. | D6/157 |
| 4,244,486 | A | 1/1981 | Ewald, Jr. | 220/646 |
| D267,387 | S | 12/1982 | Koch | D7/52 |
| 4,372,444 | A | 2/1983 | Le Grand et al. | 206/505 |
| 4,435,026 | A | 3/1984 | Johnson | 312/45 |
| 4,473,155 | A | 9/1984 | Howitt | 206/505 |
| D276,775 | S | 12/1984 | Antti et al. | D6/471 |
| 4,520,928 | A | 6/1985 | Wilson | 206/505 |
| 4,550,837 | A | 11/1985 | Simmons | 211/126 |
| 4,567,989 | A | 2/1986 | Hurst, Jr. | 211/74 |
| D283,860 | S | 5/1986 | Cantolino | D6/476 |
| D283,861 | S | 5/1986 | Cantolino | D6/471 |
| 4,634,193 | A | 1/1987 | Liu | 312/107 |
| 4,760,921 | A | 8/1988 | Licari | 206/504 |
| 5,111,939 | A | 5/1992 | Schafer | 206/503 |
| 5,127,524 | A | 7/1992 | Howitt | 206/509 |
| D330,328 | S | 10/1992 | Disesa, Jr. | D9/420 |
| 5,190,156 | A | 3/1993 | Conaway et al. | 206/509 |
| 5,287,980 | A | 2/1994 | Saltz | 220/4.27 |
| 5,417,333 | A | 5/1995 | Flum | 211/59.2 |
| 5,445,397 | A * | 8/1995 | Evans | 220/23.83 X |
| D365,229 | S | 12/1995 | Story et al. | D6/476 |
| D379,884 | S | 6/1997 | Eastman | D6/472 |
| D381,235 | S | 7/1997 | Bangert | D6/629 |
| 5,680,957 | A | 10/1997 | Liu | 220/602 |
| D394,577 | S | 5/1998 | Baluk et al. | D6/470 |
| D437,312 | S | 2/2001 | Gorman | D6/492 |
| D429,882 | S | 8/2001 | Lee et al. | D9/420 |
| D446,055 | S | 8/2001 | Lucht | D6/492 |

OTHER PUBLICATIONS

US 5,762,201, 6/1998, Whalen (withdrawn)

* cited by examiner

*Primary Examiner*—Steven Pollard
(74) *Attorney, Agent, or Firm*—David A. Burge

(57) ABSTRACT

Stackable display bins for supporting quantities of cylindrical articles such as tubes of caulk and the like have U-shaped interiors that are accessible through U-shaped front openings. The bins have generally rectangular front, rear and side walls that connect with a symmetrically curved bottom wall to define their U-shaped interiors. The front, rear and side walls extend substantially vertically so they can directly underlie and overlie the front, rear and side walls of other identically configured bins in a vertically stacked array of bins. Removable extenders connect with the bins near front ends of the right and left side walls for pivotally mounting doors at locations spaced forwardly from the U-shaped openings for supporting signs that identify the contents of the bins. Methods of utilizing single bins and pairs of bins with short and long doors and removable interior partitions to display quantities of relatively large and relatively smaller sized tubes of caulk also are disclosed.

45 Claims, 9 Drawing Sheets

STACKABLE DISPLAY BINS WITH REMOVABLE PIVOTAL DOORS

REFERENCE TO SUBJECT-MATTER RELATED APPLICATION

Reference is made to the following design applications filed (concurrently herewith) by Curtis P. Taylor and Anthony V. Sainato, which relate to appearance features that may be utilized in the practice of the present invention, the disclosures of all of which are incorporated herein by reference:

DOOR FOR DISPLAY BINS, Ser. No. 29/138,730;

DISPLAY BINS, Ser. No. 29/138,731;

DISPLAY BINS WITH PIVOTAL DOORS, Ser. No. 29/138,732; and,

FRONT PORTIONS OF STACKABLE AND STACKED DISPLAY BINS HAVING PIVOTAL DOORS, Ser. No. 29/138,733.

BACKGROUND OF THE INVENTION

1. Field of the Invention

The present invention relates to stackable bins for displaying generally cylindrical articles such as tubular containers of viscous material for sale to consumers. More particularly, the present invention relates to stackable bins having U-shaped interiors that are accessible through generally U-shaped front openings, with pivotal door assemblies being provided for that are removably connected to the bins for supporting signs that overlie the front openings of the bins to identify the contents of the bins, with the doors and the signs they carry preferably being transparent so that the contents of the bins can be viewed therethrough. Methods of displaying tubes of viscous material such as caulk and the like also form a part of the present invention, calling for the utilization of stacked arrays of front-opening bins that have short doors for overlying the front openings of short bins adapted to contain small diameter tubular containers of caulk and the like, and longer doors for overlying the front openings of taller bins and/or stacked pairs of bins that are used to contain larger diameter tubular containers of caulk and the like.

2. Prior Art

Stackable display bins of a variety of configurations have been proposed over the years. Some have pivotal doors that are intended to close front wall openings. But few are well suited for displaying large and small diameter cylindrical objects such as tubes of caulk and the like.

Displaying tubes of caulk in a stacked array is complicated by the tendency of the tubes to roll from side to side so as to not remain centered in display bins for easy access. Another complicating factor is the presence on each tube of a stiff and lengthy dispensing nozzle. If bins are made long enough to accommodate the bodies of the tubes and their nozzles, this can cause the bodies of the tubes to be positioned so far back from the fronts of bins as to render the tubes difficult to grasp. If bins are made short enough to accommodate only the bodies of the tubes but not their nozzles, the nozzles are left sticking out of the bins and may catch on the clothes of those who pass by. Moreover, providing display labels that identify the various types and colors of caulk carried in bins that have nozzles projecting therefrom has proven difficult to accomplish.

Yet another problem has been the fact that tubes of caulk typically come in one of two standard sizes. The smaller size features as a relatively small diameter and a relatively short length, and a dozen of these smaller sized tubes can be held in a relatively short, relatively small bin. The larger size has a significantly greater diameter and a longer length which requires a much more sizable storage space to accommodate an equal number of tubes. Until now, storage bins that.are well suited to displaying a good supply of smaller sized caulk tubes have proven to be poorly suited for alternatively displaying a good supply of the larger sized caulk tubes.

SUMMARY OF THE INVENTION

The present invention addresses the foregoing and other drawbacks of the prior art by providing stackable bins that are well designed to accommodate both small and large cylindrical articles such as tubes of caulk and the like—bins that are well suited to contain the bodies of tubes of caulk and the like while permitting the nozzles of these tubes to project forwardly from the bins in a guarded manner that prevents their becoming snagged on articles of clothing of those who pass by, and with removable doors being provided that overhang the forwardly projecting nozzles in a way that can support product labeling signs without necessarily preventing potential customers from viewing the tubes that are contained in the bins.

A feature of bins that embody the preferred practice of the present invention resides in providing the bins with U-shaped interiors that tend to prevent tubes of caulk and the like from rolling about—interiors that aid in maintaining an orderly display with tubes of caulk and the like aligned in a neat front-to-rear extending array—interiors that take advantage of the force of gravity to cause tubes of caulk and the like to occupy centered positions within the bins even as a bin is emptied to contain only a few tubes, or only one remaining tube.

Another feature of bins that embody the preferred practice of the present invention is the ease with which they accommodate cylindrical articles of a variety of sizes, especially the two present-day standard sizes of tubes of caulk and the like. A removable bin divider is provided to diminish the effective length of selected ones of the bins that are to be used to contain and display relatively short cylindrical articles (e.g., the smaller of two present-day standard sizes of tubes of caulk). While a single bin is well suited to contain a goodly number of the smaller of two present-day standard size of tubes of caulk, an array of two stacked bins is well suited to contain a goodly number of the larger of the two present-day standard sizes of tubes of caulk.

So that each bin can be labeled individually as to its contents, a relatively short front door is provided with sign supporting formations. However, if an array of two stacked bins is to be used to contain relatively large tubes of caulk of a particular type, a relatively long door is provided that can be pivotally connected only to the upper of the two stacked bins to overlie the fronts of both of the bins so that customers will understand that both bins contain the product that is specified on a sign attached to the door.

Other features reside in the specific construction and design of the bins that permit the bins to be molded from plastics material as single-piece or unitary structures, and in the construction and design of the long and short doors and the "extenders" or supports that connect the doors to fronts of selected bins. While, in preferred practice, the extenders are removably connected to the bins so as to facilitate changing the uses to which selected bins are put, the extenders can be formed integrally with the unitary construction of the bins.

If the extenders are removably connected to the bins, as is preferred, the extenders preferably remain pivotally connected to a particular door—so that, if a short door is to be substituted for a long door, the long door and the extenders that are pivotally connected to it may be removed as an assembly from the bin and replaced by a short door and the extenders which are pivotally connected to it. Alternatively, headed pins that snap into locked positions when inserted through aligned holes formed in the doors and the extenders to pivotally couple the doors to the extenders can be removed to permit one door to be substituted for another, whereafter the pins are reinstalled.

A feature of preferred practice that assists in assembling and maintaining stacked array of bins (and side-by-side stacked arrays of bins) is the provision on adjacent pairs of stacked bins of projections and openings that are configured to receive the projections in mating relationship. In preferred practice, upwardly extending projections are provided near the upper ends of opposed side walls of the bins, and these upwardly extending projections are received in mating relationship by downwardly facing openings that are defined near the lower ends of the opposed side walls. If mating formations of this type are provided near the rear walls of the bins, the bins preferably are configured to permit thin support brackets to be inserted between the rear end regions of adjacent pairs of the bins. The support brackets have holes through which the upwardly extending projections that are located near the rear end regions of the bins can extend to connect the support brackets to stacked arrays of bins so that the stacked arrays can be connected by the support brackets to an upstanding wall or to some other structure that is located behind the stacked arrays of the bins.

BRIEF DESCRIPTION OF THE DRAWINGS

These and other features, and a fuller understanding of the invention may be had by referring to the following description and claims, taken in conjunction with the accompanying drawings, wherein:

DESCRIPTION OF THE PREFERRED EMBODIMENT

Figure 1:
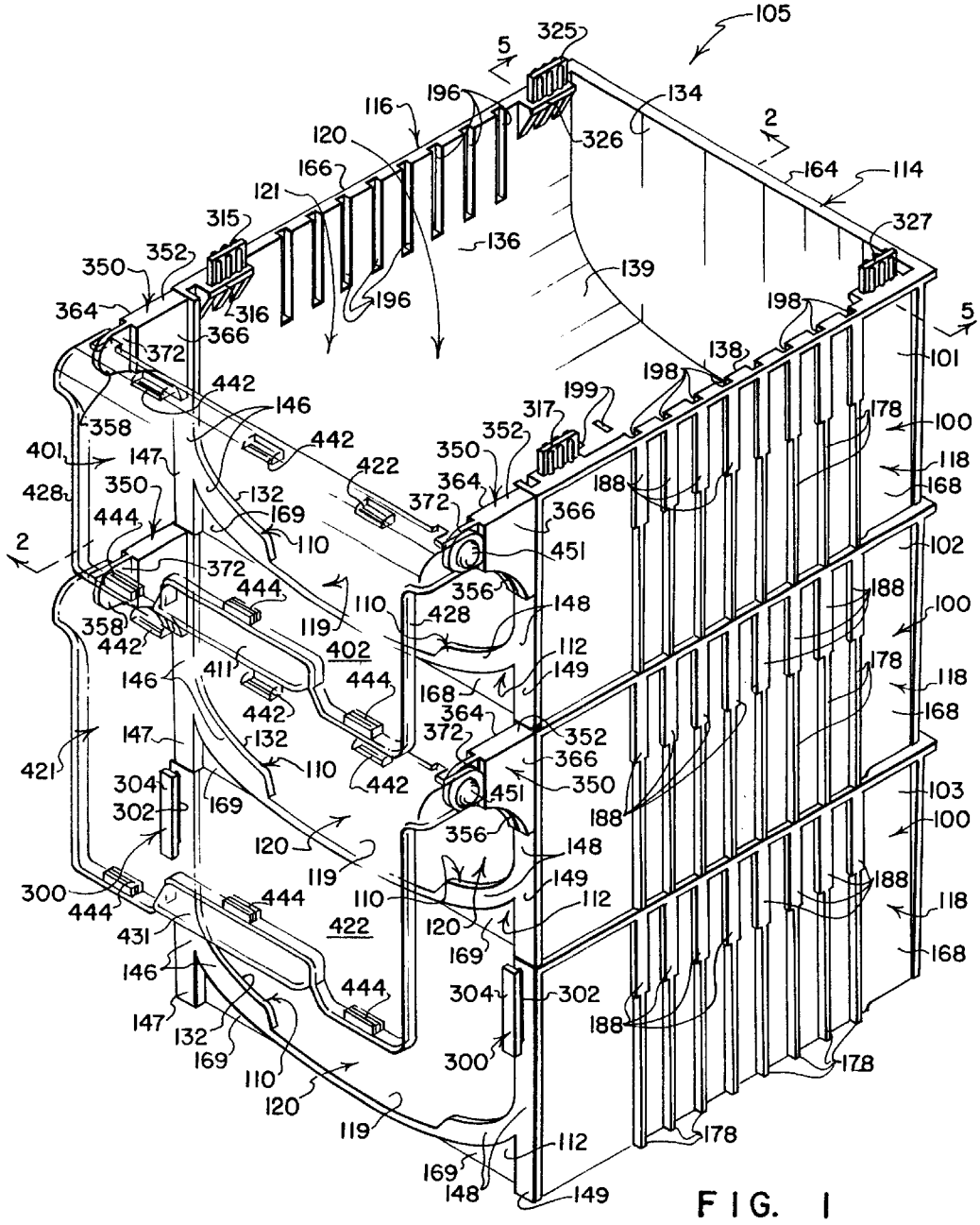
FIG. 1 is a perspective view showing principally front, right and top portions of a stack of three bins having U-shaped interiors accessible through U-shaped front openings, with the top bin in the stack having a short pivotal door removably connected thereto for supporting a sign that identifies the contents of the top bin, and with the middle bin in the stack having a longer pivotal door removably connected thereto for supporting a longer sign that identifies the contents of the middle and bottom bins of the stack.
Figure 2:
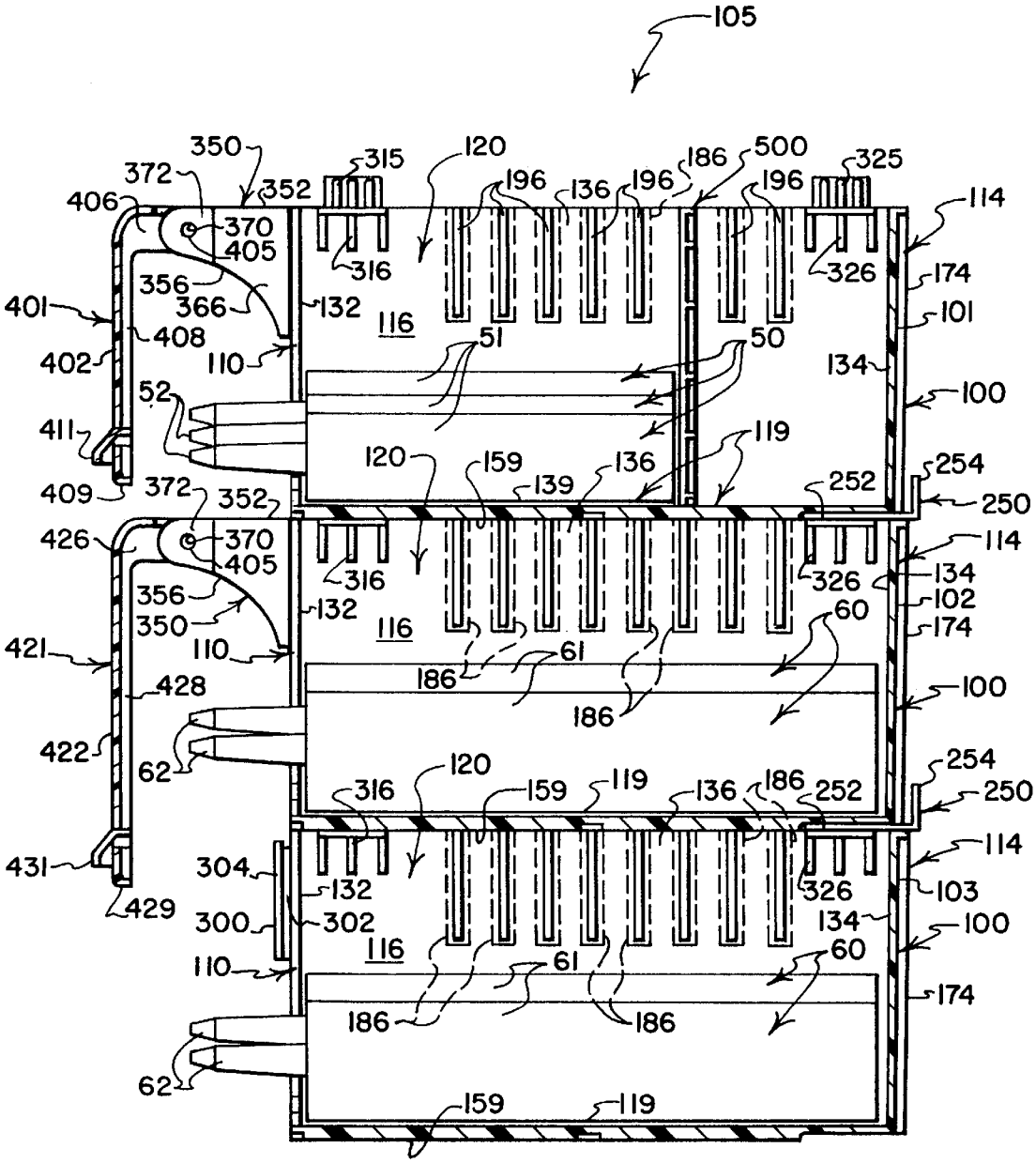
FIG. 2 is a sectional view thereof as seen from a plane indicated by a line 2—2 in FIG. 1 showing interior features of the left half of stacked bins, with a divider shown installed in the top bin to shorten the effective length of the top bin to accommodate the cylindrical bodies of a shorter/smaller of two standard sizes of caulk tubes, with a quantity of tubes of caulk of the shorter/smaller size shown in the top bin, with quantities of tubes of caulk of the longer/small size shown in the middle and bottom bins, and with L-shaped mounting brackets shown inserted between rear end regions of adjacent pairs of the stacked bins.

Referring to FIGS. 1 and 2, a stack of three identical bins 100 is indicated generally by the numeral 105. While the three depicted bins 100 are identical one with another, the reference numerals 101, 102, 103 will be used to refer to the upper bin, the middle bin and the lower bin, respectively, .that comprise the stack 105.

The upper bin 101 is provided with a short door 401 that is pivotally mounted on so-called "extenders" 350 that removably connect with and extend forwardly from the front of the upper bin 101. The middle bin 102 is provided with a long door 421 that is pivotally mounted on extenders 350 that removably connect with and extend forwardly from the front of the middle bin 102. The short door 401 overlies a major portion of the front of the upper bin 101. The long door 421 overlies the front of the middle bin 102 and a major portion of the front of the lower bin 103.

Figure 4:
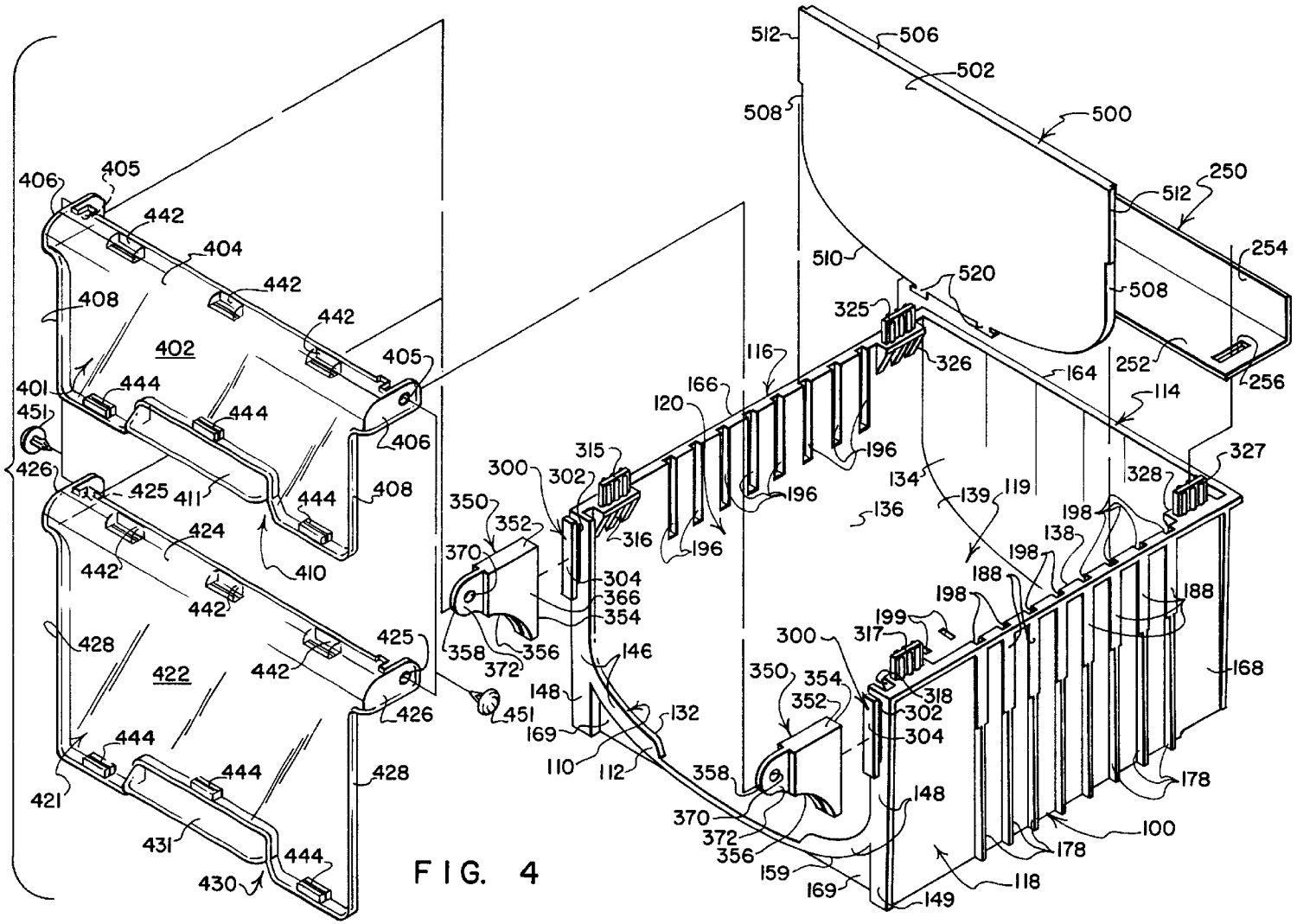
FIG. 4 is an exploded perspective view showing principally front, right and bottom portions of a typical one of the three identical bins of FIG. 1 together with the short and long doors.

The bins 100 (a typical one of which is depicted in FIG. 4) preferably are unitary structures formed utilizing injection molding techniques from opaque thermoplastic material selected to provide good strength, rigidity and durability. The doors 401, 421 (also shown in FIG. 4) preferably are unitary structures formed utilizing injection molding techniques from transparent thermoplastic material that also is selected to provide good strength, rigidity and durability.

Each of the bins 100 has a U-shaped front opening 110 that provides access to a U-shaped interior 120. While the bins 100 can, of course, be put to a variety of uses, they are particularly well suited to the display for retail sale of quantities of cylindrical articles such as standard small and standard large size tubes of caulk and the like. Referring to FIG. 2, a divider 500 is installed in the upper bin 101 to shorten the effective length of the U-shaped interior 120 of the upper bin 101 to accommodate the lengths of the generally cylindrical bodies 51 of standard small tubes of caulk, indicated by the numeral 50. The middle and lower bins 102, 103 have U-shaped interior lengths that accommodate (without a need for the dividers 500) the generally cylindrical bodies 61 of standard large tubes of caulk, which are indicated by the numeral 60. The nozzles 52, 62 of the caulk tubes 50, 62 project forwardly through the U-shaped front openings 110 of the bins 101, 102, 103, respectively, but stop short of the doors 401, 421.

While the bins 100 can, of course, be made in a variety of lengths and heights, and can be used with and without dividers of various types, to receive and support a wide variety of generally cylindrical objects that can be advantageous displayed therein for retail sale, preferred practice calls for the bins 100 to be of a common, standard size that typically can contain the bodies 51 of about a dozen of the small standard sized tubes of caulk 50. A bin width (left to right) of about twelve inches, a bin height (top to bottom of about seven inches and a bin length (front to rear) of about thirteen inches has been found to nicely suit this purpose. If an equal quantity of larger diameter objects needs to be contained and displayed, preferred practice calls for two or more of the bins 100 to be utilized—bins that are of sufficient effective length to receive the generally cylindrical bodies of such objects, for example in the manner in which the middle and lower bins 102, 103 are employed to contain the bodies 61 of the large standard caulk tubes 60, as shown in FIG. 2. By this arrangement, large side-by-side stacked arrays of bins 100 of a common size can be utilized to contain and display a great many kinds of caulk and other viscous materials contained in caulk-type tubes that are provided in two common present-day standard sizes.

A feature of the U-shaped interiors 120 of the bins 101, 102, 103 is that, as the caulk tubes 50, 60 are removed from the bins 101, 102, 103 by purchasers, the caulk tubes 50, 60 that remain in the bins 101, 102, 103 roll under the influence of gravity toward center regions of the bins 101, 102, 103, which is where the bins 101, 102, 103 are of maximum depth. Another feature of the U-shaped interiors 120 of the bins 101, 102, 103 is that the influence of gravity assists in maintaining orderly, side-by-side, front-to-rear alignments of the bodies 51, 61 of such caulk tubes 50, 60 as remain in the bins 101, 102, 103 so that the resulting display of the caulk tubes 50, 60 tends at all times to offer an attractive and orderly appearance that requires very little, if any, manual day-to-day repositioning of the caulk tubes 50, 60 by the employees of a retail store.

Figure 5:
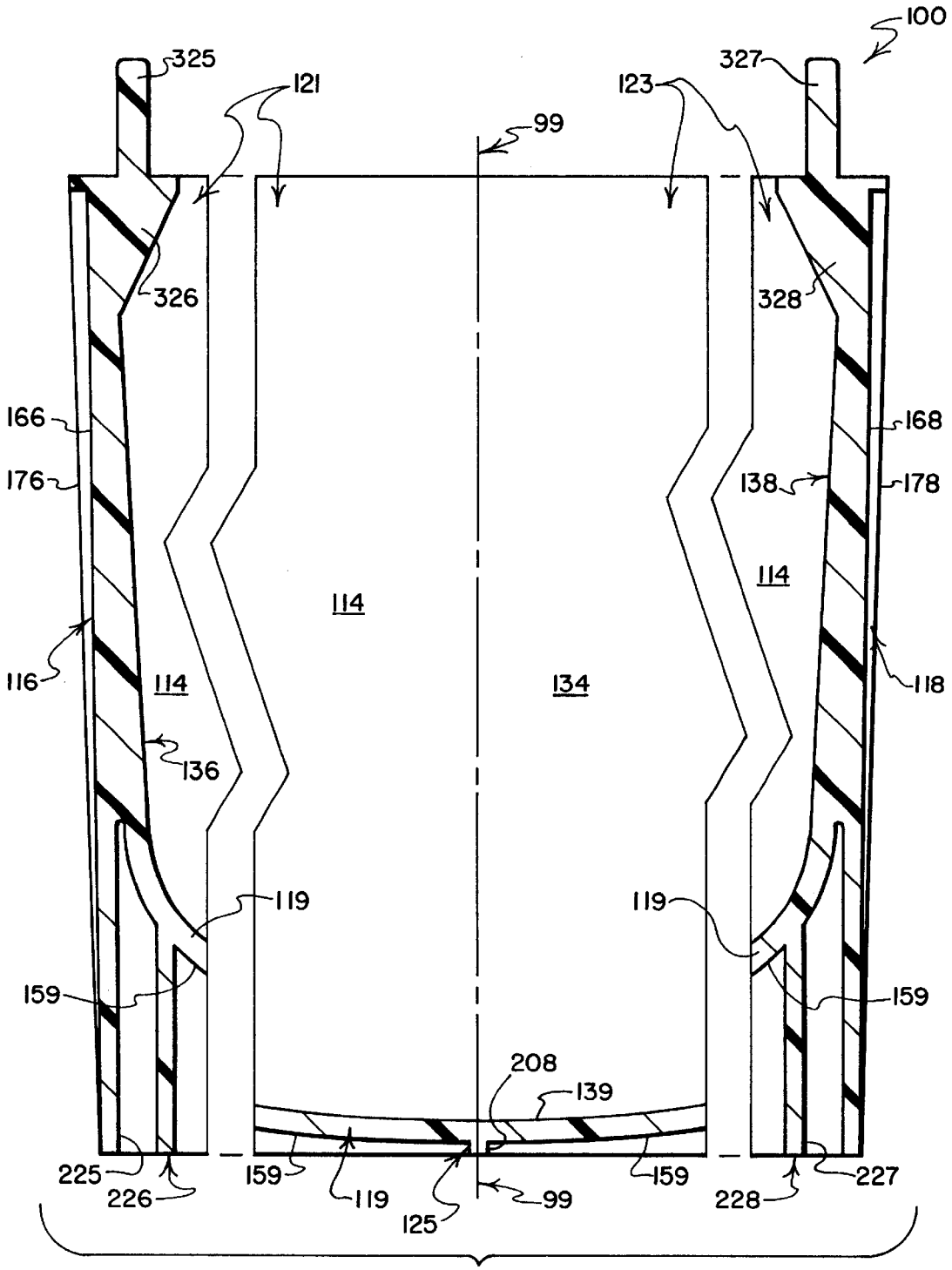
FIG. 5 is a foreshortened sectional view showing, on an enlarged scale, left, right and central portions of a cross-section of the upper bin of the stack of bins shown in FIG. 1, as seen from a plane indicated by a line 5—5 in FIG. 1.

Referring to FIGS. 4 and 5, the U-shaped cross-section or interior configuration 120 remains substantially uniform (i.e., unchanging in shape) as it extends through the interior 120 of the bin 100 from front to rear. Referring to FIG. 5, an imaginary upstanding center plane located midway between and paralleling opposite sides of the bin 100 is indicated by the numeral 99 in FIG. 5. The center plane 99 divides the U-shaped interior 120 into left and right halves 121, 123 that are symmetrical about the center plane 99 inasmuch as the left half 121 has a size and shape that is the mirror image of the size and shape of the right half 123, and vice versa.

Figure 3:
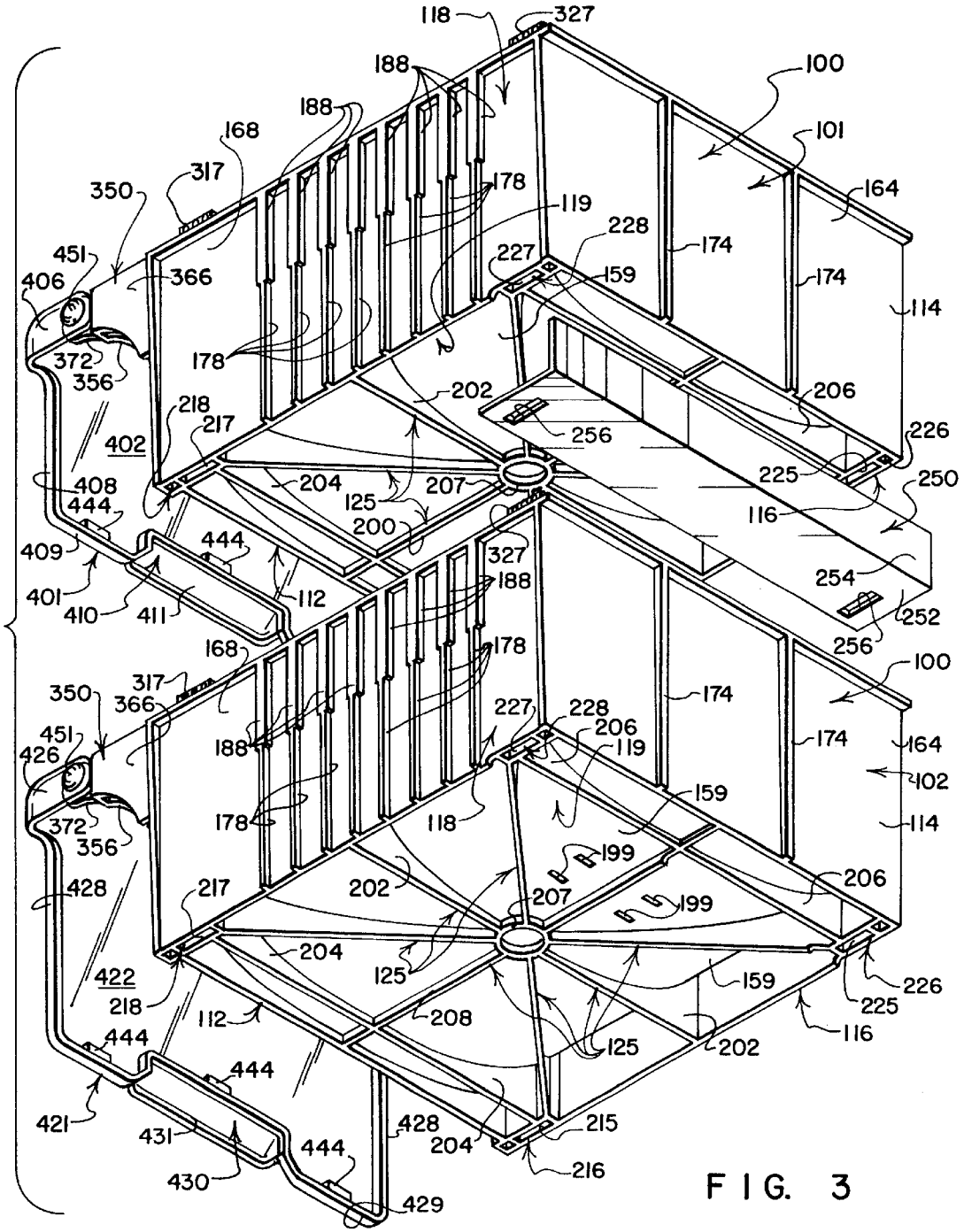
FIG. 3 is a perspective view showing principally rear, right and bottom portions of the top and middle bins and one mounting bracket insertable between rear end regions of the top and middle bins.

Referring to FIGS. 3 and 4, the bin 100 has generally rectangular, parallel extending, upstanding front and rear walls 112, 114, and generally rectangular, parallel extending, upstanding left and right side walls 116, 118. The upstanding front, rear and side walls 112, 114, 116, 118 are joined by a curved bottom wall 119 that is rigidified and strengthened by an array of upstanding rib formations indicated generally by the numeral 125 in FIG. 3.

The interior of the bin 100 is defined principally by upstanding, substantially flat interior surfaces 132, 134, 136, 138 of the upstanding walls 112, 114, 116, 118, respectively; and by a concave, upwardly-facing interior surface 139 of the curved bottom wall 119. The interior surfaces 132 of the front wall 112 are defined by J-shaped portions 146, 148 of the front wall 112. The J-shaped portions 146, 148 also have exterior surfaces which extend in substantially the same plane as do exterior surfaces of post-like corner formations 147, 149 that join with and depend from the vertically extending stems of the J-shaped portions 146, 148, respectively. Recessed so as to underlie the front end region of the concavely curved, downwardly facing exterior 159 of the bottom wall 119 is a front wall portion 169 (see FIG. 4) that extends between the post-like corner formations 147, 149.

Other exterior features of the bin 100 include the exterior surfaces 164, 166, 168 of the rear wall 114 and the left and right side walls 116, 118, respectively. Referring to FIG. 3, vertically extending ribs 174 interrupt the otherwise smooth exterior surface 164 of the rear wall 114; and, referring to FIG. 1, vertically extending ribs 176, 178 (that are of substantially identical configuration but which face in opposite directions at locations on opposite sides of the bin 100) interrupt the otherwise smooth exterior surfaces 166, 168 of the left and right side walls 116, 118, respectively. The ribs 176, 178 have enlarged upper regions 186, 188 that are of sufficient size to permit vertically extending grooves 196, 198 (that face inwardly into the U-shaped interior 120 of the bin 100) to be formed in upper portions of the interior surfaces 136, 138 of the left and right side walls 116, 118. Slots 199 are formed through the bottom wall 119 in alignment left and right pairs of the grooves 196, 198 to enable a divider 500 to be installed in the bin 100 to segregate front and rear regions of the U-shaped interior 120 of the bin 100. If the divider 500 is to be installable in all of the opposed pairs of grooves 196, 198, slots 199 are provided in the bottom wall 119 of the bin 100 that align with each of the opposed pairs of grooves 196, 198 (instead of just the two pairs of slots 199 that are depicted in the bottom wall 119 in FIG. 3).

Still other exterior features of the bin 100 include connector formations 300 that extend forwardly from upper end regions of the exterior surfaces of the J-shaped front wall portions 146, 148. The formations 300 are of T-shaped cross-section, having a narrow upstanding stem portions 302 and wider cross-bar portions 304.

Referring to FIG. 3, the rib-like formations 125 that underlie the exterior surface 159 of the bottom wall 119 include a front-to-rear extending rib 208 (see FIG. 5) that joins with the front and rear walls 112, 114 and extends in the center plane 99; left and right front corner formations 216, 218; left and right rear corner formations 226, 228; a transversely extending central rib 202 that joins with the left and right side walls 116, 118; a transversely extending front rib 204 that joins with the front corner formations 216, 218; and a transversely extending rear rib 206 that joins with the rear corner formations 226, 228; diagonal ribs 205 that extend between diagonal pairs of the corner formations 216, 218, 226, 228; and a circular central rib 207 that joins centrally with the ribs 202, 205, 208.

The corner formations 216, 218, 226, 228 define downwardly facing openings 215, 217, 225, 227, respectively, that extend upwardly at locations beneath the bottom wall 119 (see FIG. 5 wherein the openings 225, 227 are shown in cross-section). At locations directly above the openings 215, 217, 225, 227, upwardly projecting tabs 315, 317, 325, 327 (see FIG. 4) are supported by understructures 316, 318, 326, 328, respectively. The understructures 316, 326 connect with the left side wall 116. The understructures 318, 328 connect with the right side wall 118. The tabs 315, 317, 325, 327 are configured to be received in a slip fit within the openings 215, 217, 225, 227 of an identical one of the bins 100 which is supported atop the bin 100 in a manner that is depicted in FIGS. 1 and 2. The openings 215, 217, 225, 227 are configured to receive the tabs 315, 317, 325, 327 of an identical one of the bins 100 which underlies the bin 100 in the manner depicted in FIGS. 1 and 2.

Referring to FIG. 2, rear bottom portions of the bins 100 may be shortened or cut away to permit a horizontally extending leg 252 of an L-shaped bracket 250 to be received between the rear bottom portions of one of the bins 100 of the stack 105 and rear top portions of another of the bins 100 of the stack 105. As depicted in FIG. 2, the L-shaped bracket has a vertically extending leg 254 that parallels the rear walls 114 of the bins 100 of the stack 105 at a location spaced a short distance rearwardly therefrom. The vertically extending leg 254 can be attached by suitable fasteners (not shown) to a wall of a building or to some other structure that is located behind the stack 105 to ensure that the bins 100 of the stack 105 remain in place over long periods of time and to conform with building code requirements that may require tall arrays of bins to be secured rather than free-standing.

Referring to FIG. 3, the shortening of rear portions of a bin 100 that is needed to permit the horizontally extending leg 252 of the bracket 250 to be received between a pair of adjacent bins 100 of the stack 105 requires that rear wall 114, the rib 206, and the corner formations 226, 228 be shortened together with rear portions of the side walls 116, 118 and the rib 208. The preferred manner of connecting the horizontally extending leg 252 to the bins 100 of the stack 105 is to provide holes 256 near opposite end regions of the leg 252 that are configured to receive the upstanding tabs 325, 327 in a slip fit. If side-by-side stacks 105 of the bins 100 are being provided along along a wall of a building, the L-shaped brackets 250 that are used at selected heights of the stacks 105 to couple the stacks 105 to the wall may be quite lengthy so as to provide tab-receiving openings 256 at locations that are appropriate for holding the stacks 105 of bins 100 in proper side-by-side relationship while also connecting the stacks 105 to the wall.

Referring to FIG. 4, it will be seen that relatively short and relatively long doors 401, 421 of very similar construction are provided for being removably attached to the bin. In FIGS. 1 and 2, one of the relatively short doors 401 is shown attached to the upper bin 101 to overhang a major portion of the U-shaped front opening 110 of the upper bin 101, and one of the relatively longer doors 421 is shown attached to the middle bin 102 to overhang not only the U-shaped front opening 110 of the middle bin 102 but also a major portion of the U-shaped front opening 110 of the lower bin 103. While no door is attached to the lower bin 103, it will be seen that elongate undercut connector formations 300 of generally T-shaped cross-section are provided on the lower bin 103 for permitting one or the other of the short and long doors 401, 421 to be removably mounted thereon (if such is desired) by attaching a pair of the extenders 350 to the connectors 300.

Figure 6:
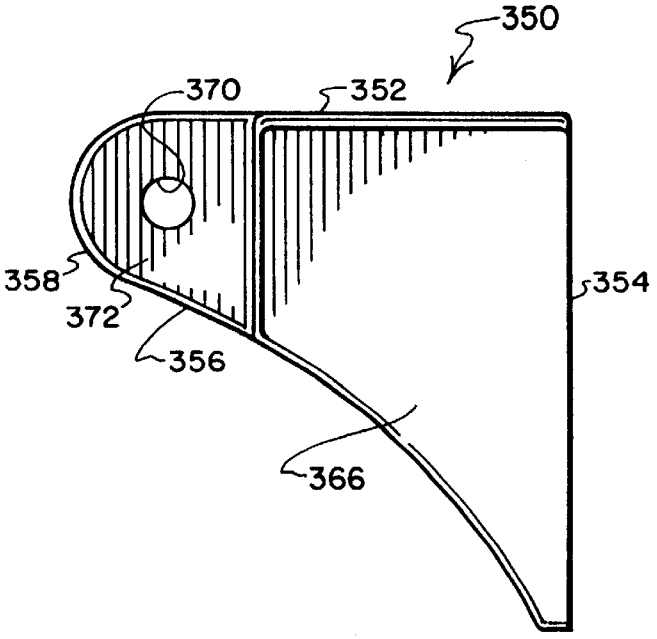
FIG. 6 is a side elevational view, on an enlarged scale, of one of two "extenders" utilized to pivotally support either end of the short and long doors.

Referring to FIGS. 5 and 6, the extenders 350 are of generally triangular configuration. Each of the extenders 350 has a top wall 352 and a rear wall 354 that extend substantially at right angles to each other; and an inclined, curved bottom wall 356 that extends from the bottom of the rear wall 354 to join smoothly with one end of a somewhat semi-circular front surface 358. The other end of the semi-circular front surface 358 joins smoothly with the top wall 352.

Figure 7:
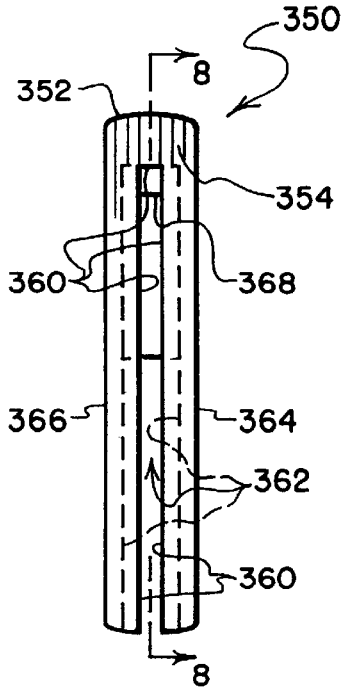
FIG. 7 is a right end view thereof.
Figure 8:
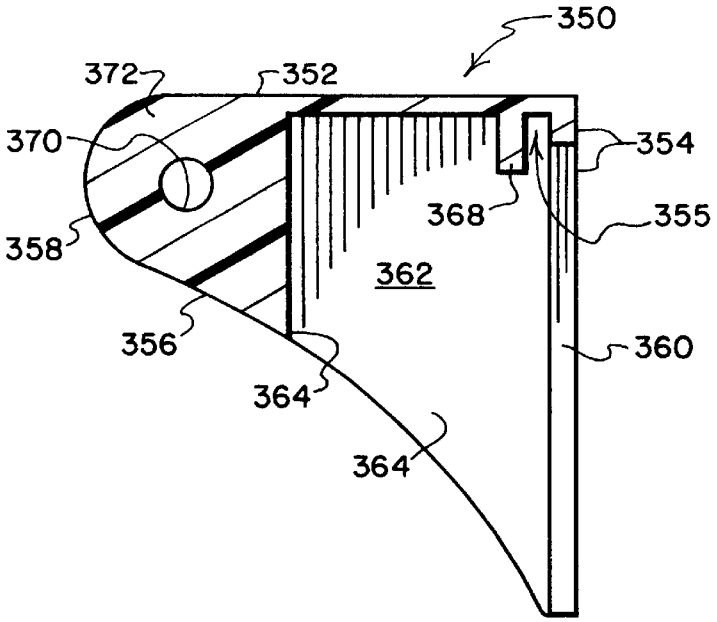
FIG. 8 is a sectional view as seen from a plane indicated by a line 8—8 in FIG. 7.

Referring to FIGS. 7 and 8, an inverted U-shaped opening 360 is formed through the rear wall 354 of each of the extenders 350. The opening 360 is relatively narrow and provides access through the rear wall 354 to a much wider chamber 362 that extends forwardly from an inside surface of the rear wall 354 to a vertically extending surface 364. As is best seen in FIG. 8, the chamber 362 is closed at its upper end by the top wall 352 but opens downwardly through the curved bottom wall 356. Left and right side walls 364, 366 (see FIG. 7) of the extender 350 close opposite sides of the chamber 362, and are interconnected near the rear of the top wall 352 by a tab-like formation 368 (see FIG. 8) that depends into the chamber 362 from the top wall 352 at a distance spaced forwardly from the rear wall 354. A space 355 is defined between the rear wall 352 and the depending tab-like formation 368.

Referring to FIG. 4, one of the extenders 350 can be removably installed on one of the connectors 300 by inserting the crossbar portion 304 of the connector 300 into the downwardly opening chamber 362 while bringing the stem portion 302 of the connector 300 into the inverted U-shaped opening 360. The extender 350 is slided onto the connector 300 in this manner until the upper end of the crossbar portion 304 extends into the space 355, and until the stem portion 302 engages the upper end of the inverted U-shaped opening 360.

Because the left half of the extender 350 is identical to the right half of the extender 350 (except that the left half has a configuration that is a mirror image reversal of the configuration of the right half), the left and right halves of the extender 350 can be said to be symmetrical about an imaginary plane that extends centrally through the extender 350, as is indicated by the line 8—8 in FIG. 7. A hole 370 is formed through a front part 372 of the extender 350. When a pair of extenders 350 is mounted on a pair of the connectors 300 of one of the bins 100 in the manner depicted in FIGS. 1–3, the axes of the holes 370 of these extenders 350 align to define the pivot axis of one of the doors 401, 421. Referring to FIG. 4, the doors 401, 421 are mounted on the extenders 350 by inserting headed fasteners 451 through the holes 370 of the extenders 350 and through holes 405, 425 that are formed through rearwardly extending end regions 406, 426 of the doors 401, 421, respectively.

Figure 9:
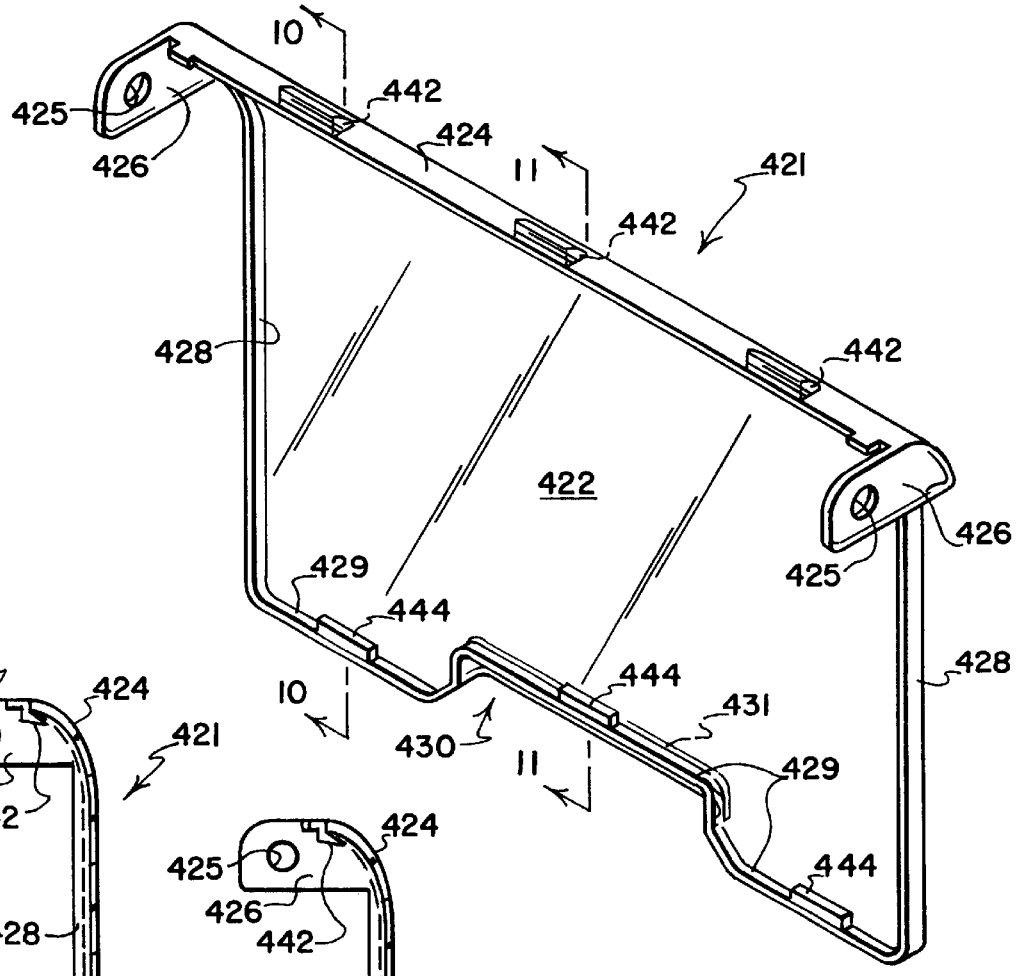
FIG. 9 is a perspective view showing principally rear, top and left end portions of one of the doors depicted in FIG. 1.
Figure 10:
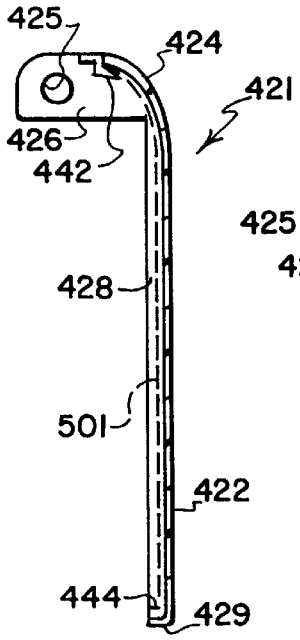
FIG. 10 is a sectional view as seen from a plane indicated by a line 10—10 in FIG. 9, with broken lines indicating a position that can be occupied by a sign to identify the contents of an adjacent bin or bins.
Figure 11:
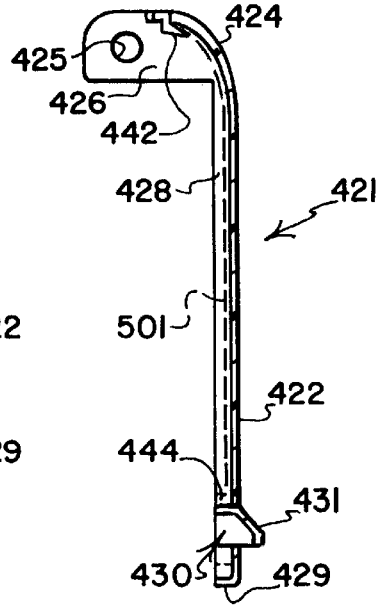
FIG. 11 is a sectional view as seen from a plane indicated by a line 11—11 in FIG. 9, with broken lines again indicating a position that can be occupied by the sign.

Referring to FIG. 4 (wherein both the short door 401 and the long door 421 are shown) and to FIGS. 9-11 (where features of the long door 421 are shown in greater detail), it will be understood that the only difference between the doors 401, 421 is their vertical length or height. The doors 401, 421 have transparent, generally rectangular, substantially flat front walls 402, 422 bordered along their upper regions by curved, rearwardly turned top formations 404, 424 that join at opposite ends with rearwardly extending projections 406, 426 that define the pivotal mounting holes 405, 425, respectively. The front walls 402, 422 are bordered at opposite ends by rearwardly turned end flanges 408, 428, and along the bottom by rearwardly turned bottom flanges 409, 429, respectively. At central locations along the bottom walls 409, 429, raised regions 410, 430 are provided with forwardly projecting hand grips 411, 431, respectively. The hand grips 411, 431 have identical cross-sections, one of which is depicted in FIG. 11 where a central cross-section of the longer door 421 is shown.

To enable signs to be attached to the doors 401, 421 for the purpose of identifying the contents of bins that have their front openings 110 overhung by the doors 401, 421, tabs 442 depend downwardly and forwardly (in L-shaped cross-section) from the curved top formations 404, 424, and tabs 444 extend upwardly from the bottom flanges 409, 429 (see FIGS. 9–11 wherein the tabs 442, 444 that are provided on the longer door 421 are depicted, and FIGS. 1 and 4 wherein the tabs 442, 444 that are provided on both of the doors 401, 421 are depicted).

Referring to FIGS. 10 and 11 wherein a typical one of the signs 450 is shown in phantom (with top edge portions of the sign 450 inserted above and behind the downwardly and forwardly projecting bottom portions of the L-shaped depending tabs 442, and with bottom edge portions of the sign 450 inserted behind the upstanding tabs 444), it will be seen that the tabs 442, 444 serve to hold the signs 450 in place adjacent the interior surfaces of the flat front walls 402, 422 of the doors 401, 421 and against the interior surfaces of the curved top formations 404, 424 of the doors 401, 421 in two ways. First, by extending for short distances behind the top and bottom edge portions of the signs 450 so as to physically retain the top and bottom edges of the signs 450 in place. And, second, by requiring that upper portions of the signs 450 assume curved configurations adjacent the curved top formations 404, 424 (which brings into play the "memory" of the flat transparent plastic material from which the signs 450 preferably are formed—a "memory" that causes the material of the signs 450 to try to flatten out) which stresses the material of the signs 450 causing the signs to press firmly against the flat interior surfaces of the front walls 402, 422 and against the curved interior surfaces of the top formations 404, 424 of the doors 401, 421, respectively. Thus, the signs 450 conform closely to the interior shapes of the doors 401, 421 and give a good outward appearance to whatever indicia the signs 450 carry that are viewable through the transparent fronts 402, 422 and through the transparent top portions 404, 424.

In preferred practice, the signs 450 carry letters, numbers or other appropriate indicia (not shown) to identify such cylindrical articles as may be contained in the bins 101, 102, 103 of the stack 105 (see FIGS. 1 and 2)—such as the relatively small standard-sized caulk tubes 50 that are shown supported in the bin 101 in FIG. 2, and the relatively large standard-sized caulk tubes 60 that are shown supported in the bins 102, 103 in FIG. 2. While the bin 101 (which is overhung by the short door 401) is of sufficient size to permit a good quantity of the small standard-sized caulk tubes 50 to be displayed therein for retail sale, the combination of the bins 102, 103 (which are overhung by the longer door 421) preferably are used to display approximately the same number of the relatively large standard-sized caulk tubes 60. A sign (such as the sign 450 depicted in FIGS. 10 and 11) that covers the interior of the front wall 402 of the bin 101 identifies the contents of the bin 101, while the sign 450 which covers the interior of the front wall 422 of the bin 101 (in the manner depicted in FIGS. 10 and 11) identifies the contents of the bins 102, 103.

Referring to FIG. 2, it will be seen that, while the bins 102, 103 are of appropriate lengths to receive the cylindrical bodies 61 of the large standard-sized caulk tubes 60 (leaving the nozzles 62 of the large caulk tubes 60 projecting forwardly through the U-shaped openings 110 of the bins 102, 103 toward the door 421 that overhangs the bins 102, 103), the length of the bin 101 is effectively shortened by inserting a divider 500 positioned behind the bodies 51 of the small standard-sized caulk tubes 50 (leaving the nozzles 462 of these tubes projecting forwardly through the.U-shaped opening 110 of the bin 101 toward the door 401 that overhangs the bin 101).

The method of displaying short and long cylindrical articles 50, 60 utilizing stacked bins 101, 102, 103 having U-shaped interiors 120 that have their effective lengths adjusted by the use of the dividers 500; and the method of displaying relatively small and relatively larger diameter cylindrical articles 50, 60 utilizing one bin 101 for the small diameter articles 50 and a plurality of bins 102, 103 for the large diameter articles 60 so that good quantities of each size of the articles 50, 60 can be provided in a binned array for retail sale; and the method of utilizing relatively short 401 to identify the contents of the single bin 101 and the relatively longer door 421 to identify the contents of the plurality of bins 102, 103, respectively, represent an approach that is not taught or suggested by prior proposals.

Figure 12:
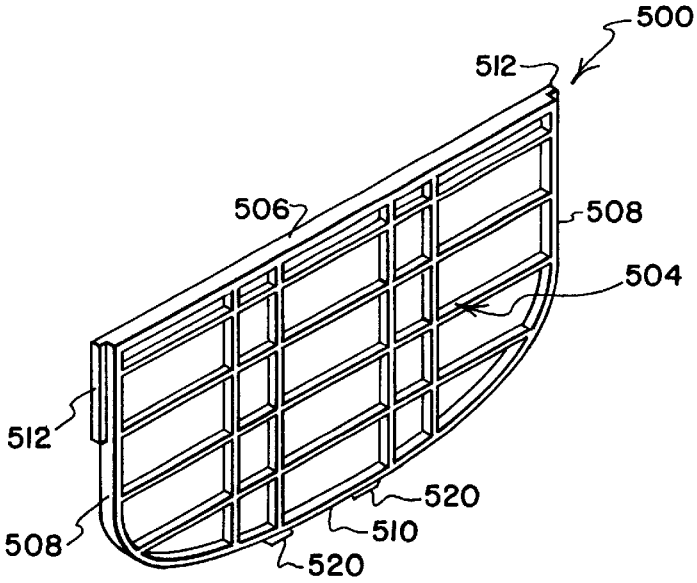
FIG. 12 is a perspective view showing principally top, right and rear portions of the divider that is shown installed in the upper bin in FIG. 2.
Figure 13:
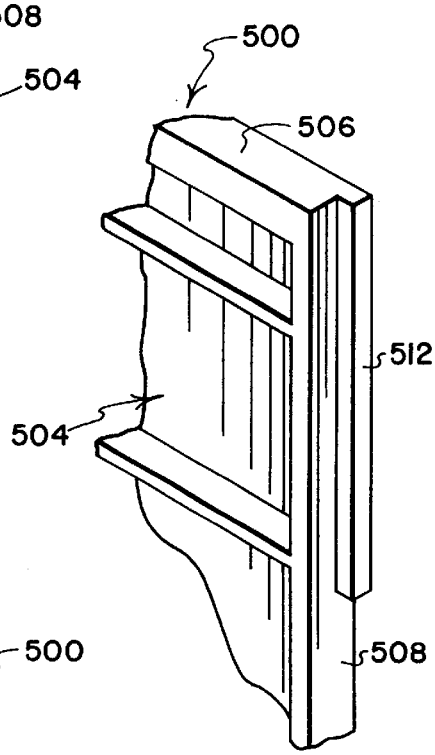
FIG. 13 is an enlarged perspective view of one an end portion thereof.
Figure 14:
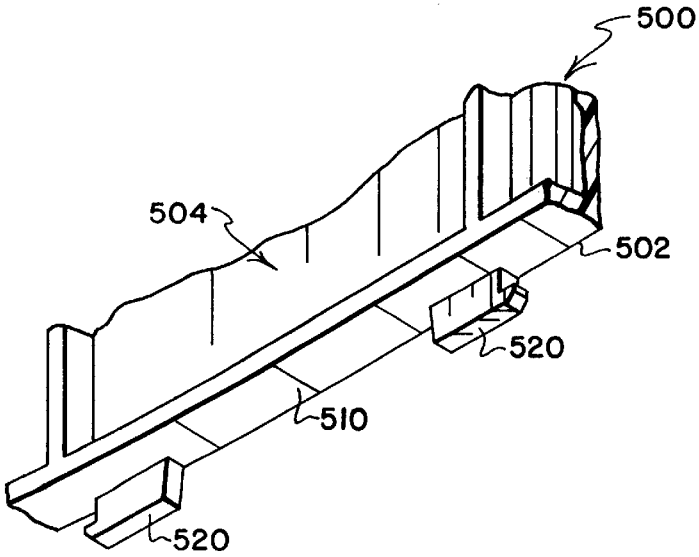
FIG. 14 is an enlarged perspective view of a bottom portion thereof.
Figure 15:
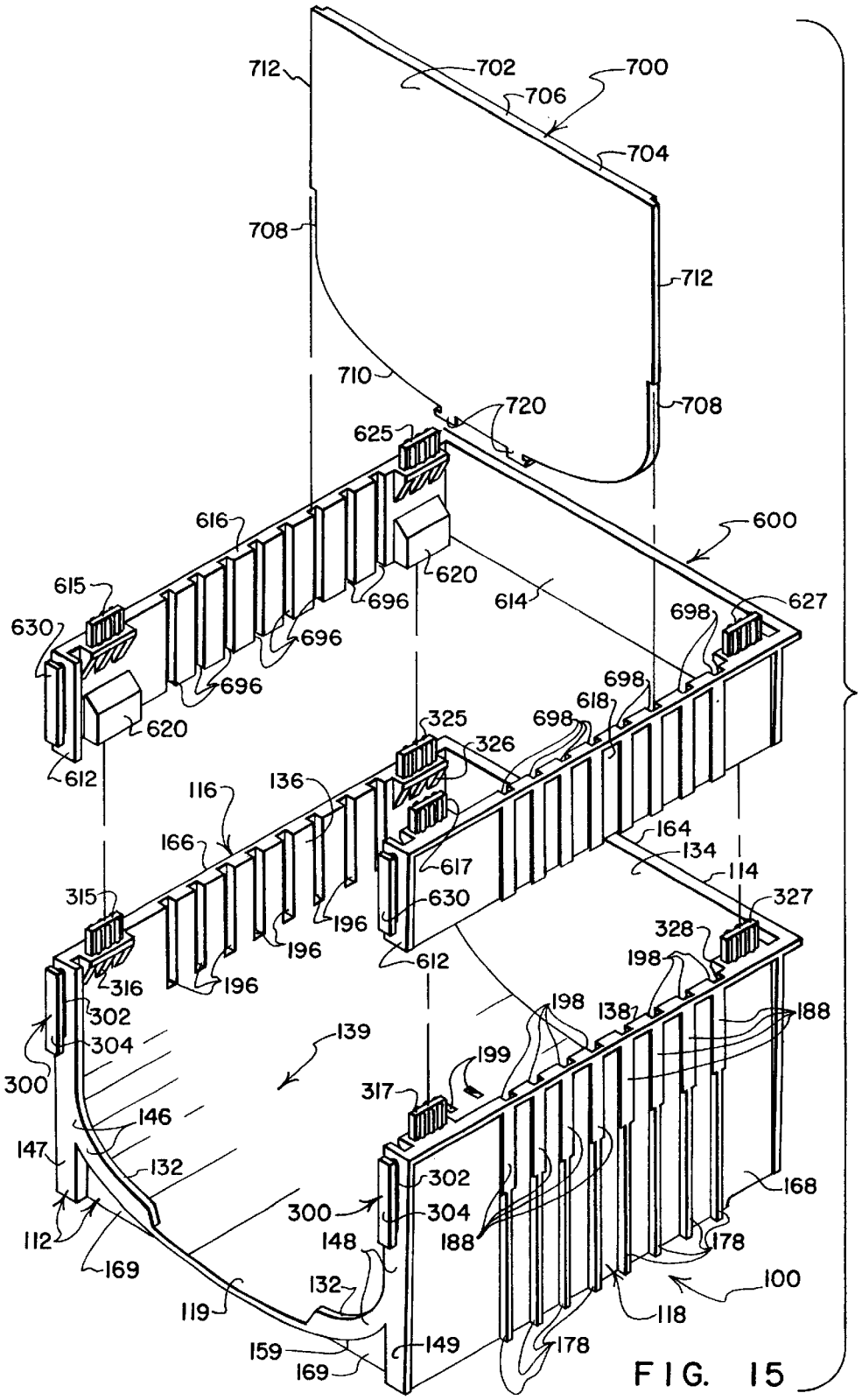
FIG. 15 is an exploded perspective view showing one of the bins of FIG. 1 together with a bin height extender which can be provided to increase the capacity of a bin to contain cylindrical articles such as the tubes of caulk, with the view also showing a tall divider that can be used to diminish the effective length of the extended bin.

Referring to FIGS. 4 and 12, the divider 500 has a smooth front face 502 and a cross-ribbed rear face 504 that are bordered by a top wall 506 and a U-shaped combination of side and bottom walls 508, 510. Referring to FIG. 12, upstanding projections 512 are provided near where the side walls 510 join with the top wall 506. One of the identical projections 512 also is shown in FIG. 13. Referring to FIGS. 12 and 14, hook-shaped feet 520 that open in opposite directions are provided at spaced locations along the bottom wall 510.

Referring to FIG. 4, the upstanding projections 512 are sized and configured to be received in a close slip fit within the recesses or grooves 196, 198 that are defined by the upstanding side walls 116, 118, respectively of the bin 100. When the divider 500 is lowered into the bin 100 (as is depicted in FIG. 2) to insert the projections 512 into the grooves 196, 198, the feet 520 are caused to extend through the slot-like openings 199 that are provided where needed in the bottom wall 119 of the bin 100. By this arrangement, the divider 510 is retained in position unless and until lifted out of the bin 100 to release the hook-shaped feet 520 from the slot-like openings 199, and to withdraw the upstanding projections 512 from the recesses or grooves 196, 198.

While preferred practice calls for the holding capacity or size of the bins 100 to be designed to permit a goodly number of the standard small caulk tubes 50 (such as a dozen or so) to be contained and displayed for sale (in the manner in which the small caulk tubes 50 are contained and displayed in the bin 101 in FIG. 2); and for the holding capacity of a pair of the bins 100 to be designed to permit a goodly number (typically a dozen or more) of the standard large caulk tubes 60 to be contained and displayed for sale (in the manner in which the large caulk tubes 60 are contained and displayed in the bins 102, 103 in FIG. 2); there may arise applications when one or more of the bins 100 needs to have taller upstanding front, rear and side walls to enhance its holding capacity. While taller bins (not shown) clearly can be provided for this purpose (i.e., bins that provide the described features of the bins 100 but that have taller front, rear and side walls), an alternate approach is illustrated in FIG. 13.

Referring to FIG. 13, a vertical wall extension unit 600 is depicted which has front, rear and side wall portions 612, 614, 616, 618 that are designed to overlie the upstanding front, rear and side walls 112, 114, 116, 118, respectively, of one of the bins 100. Corner formations 620 are provided at opposite ends of the side walls 616, 618 to define openings (not shown) that serve in the manner of the openings 215, 217, 225, 227 (see FIG. 3) to receive the upstanding tabs 315, 317, 325, 327 of the bin 100; and, corresponding upstanding tabs 615, 617, 625, 627 are provided for extending into the openings 215, 217, 225, 227 of a bin that may be seated atop the wall portions 612, 614, 616, 618. The side wall portions 616, 618 define grooves 696, 698 that serve as extensions of the grooves 196, 198 of the side walls 116, 118, respectively. Connectors 630 of T-shaped cross-section are provided on the front walls 612 that overlie and are of the same configuration as the connectors 300 of the bin 100.

The combination of a bin 100 with the extension unit 600 in place atop the bin 100 is referred to as an "extended bin." To adjust the effective length of the U-shaped interior of such an extended bin, a special tall divider 700 is provided which has a greater height than the divider 500 and has longer upstanding projections 712 than the projections 512 of the divider 500. The divider 700 has front and rear walls 702, 704 like the front and rear walls 502, 504 of the divider 500; and, the divider 700 has top, side and bottom walls 706, 708, 710 that correspond to and are configured similarly to the top, side and bottom walls 506, 508, 510, respectively, of the divider 500.

The projections 712 are configured to extend into the aligned recesses or groves 196, 198 as extended by the recesses or grooves 696, 698 of the extension unit 600. The tall divider 700 has feet 720 that are identical to the hook-shaped feet 520 of the divider 500 for extending into appropriately position slot-like openings 199 formed through the bottom wall 119.

While features of the bins 100 and the manner of their preferred use provide a number of points of novelty that are intended to be covered by the claims that follow, a few of these features merit final comment. It clearly is not the purpose of the doors 401, 421 to fully close the U-shaped front openings 110 of the bins 101, 102, 103 of the stack 105 shown in FIGS. 1 and 2. Indeed, the door 401 is too short to fully cover the opening 110 of the upper bin 101, and the door 421 is to short to fully cover the opening 110 of the lower bin 103. Moreover, the extenders 350 position the doors 401, 421 (and their pivot axes) several inches forwardly from the front walls 112 of the bins 101, 102, 103, thereby rendering it impossible for the doors 401, 421 to perform conventional "closure" functions.

Instead of performing conventional "closure" functions, the doors 401, 421 act to guard or shield the nozzles 52, 62 of the caulk tubes 50, 60 from contact with the clothes of passers by and from being struck by objects being carried by passers by; and, the doors 401, 421 serve to carry signs 450 that identify the contents of the bins that the doors 401, 421 overlie. The use of a combination of short and long doors 401, 421 permits bins 100 of uniform size to be used singly or in combination to contain selected products—while ensuring that the contents of such bins are clearly delineated, distinguished and identified so that customers can find them with ease.

If, as is preferred, the doors 401, 421 and the signs 450 are made from transparent material (so that only the letters of the signs 450 may serve to somewhat block the view of the contents of the bins 100 that are overhung by the doors 401, 421), it remains possible for customers to see the contents of the bins 100 and to readily grasp and remove caulk tubes and the like from the bins 100.

The U-shaped interiors 120 of the bins 100 also do much to improve the character of displays of caulk tubes and the like that are provided in stacked arrays of the bins 100. Because the U-shaped interiors 120 have their greatest depth at locations centered on the doors 401, 421, caulk tubes 50, 60 carried in the bins tend to roll toward the center of the bins 100 where they can be seen and grasped with ease when the doors 401, 421 are pivoted open. Furthermore, the force of gravity also serves to help keep caulk tubes (and other cylindrical articles displayed in the bins 100) aligned front-to-rear extending arrays that permit the caulk tubes to assume the lowest possible locations within the U-shaped interiors 120 of the bins. Stated in another way, the U-shaped interiors 120 of the bins 100 permit gravity to aid in maintaining neat and orderly displays.

The lengths of the doors 401, 421 is selected with care to ensure that the task of opening of any one of the doors 401, 421 is not impeded by the presence of others of the doors 401, 421: lower doors do not bump against upper doors when being opened. The abbreviated lengths of the doors 401, 421 also provides door bottom surfaces that are easily grasped to facilitate the opening of the doors; and helps stock personnel to see when bins are becoming empty and need to be restocked. The rounded upper surfaces 404, 424 of the doors 401, 421 also help to ensure that lower doors do not engage upper doors during opening of the lower doors, and assists in affording arrays of the bins 100 with a good overall appearance.

Although the invention has been described in its preferred form with a certain degree of particularity, it is understood that the present disclosure of the preferred form has been made only by way of example, and that numerous changes in the details of construction and the combination and arrangement of parts may be resorted to without departing from the spirit and scope of the invention as hereinafter claimed. It is intended to protect whatever features of patentable novelty exist in the invention disclosed.

What is claimed is:

1. A generally rectangular open-top container having upstanding, generally rectangular front and rear walls that are connected by upstanding, generally rectangular left and right side walls, and by a curved bottom wall that defines an upwardly facing, generally concave interior surface that joins smoothly and contiguously with upper interior surface portions of the left and right side walls to define a bin of substantially U-shaped cross section that extends from the front wall to the rear wall, with means for strengthening and rigidifying the bottom wall being provided directly beneath the bottom wall and being connected to the bottom wall and to lower interior surface portions of the left and right side walls to enable the bin of the container to receive and support generally cylindrical articles stacked in the bin in a parallel front-to-rear extending array, and with a substantially U-shaped front opening formed through the front wall to provide access to the bin and to said articles stacked in said array therein.

2. The container of claim 1 wherein the front and rear walls, the left and right side walls, and the bottom wall are formed as a unitary structure molded from plastics material.

3. The container of claim 1 wherein the bin has left and right side regions that extend upwardly from the interior surface of the bottom wall, with the left side region extending from the upper interior surface of the left side wall to an imaginary upstanding center plane that extends centrally through the bin from the front wall to the rear wall at a location mid-way between the upper interior surface portions of the left and right side walls, with the right side region extending from the upper interior surface of the right side wall to the imaginary upstanding center plane, and with the left and right side walls and the bottom wall being configured so that the left and right side regions are symmetrical about the center plane and are of substantially identical configuration except that the configurations of the left and right side regions are mirror image reversals of each other.

4. The container of claim 1 wherein the left and right side walls and the rear wall define top surfaces having portions that face upwardly and extend substantially in a common horizontal plane.

5. The container of claim 4 wherein the front and rear walls, the left and right side walls, and the bottom wall are formed as a unitary structure molded from plastics material.

6. The container of claim 4 wherein substantially vertically extending grooves that open into the bin are provided in the left and right side walls for receiving opposite ends of a removable divider adapted to segregate a rear portion of the bin from a front portion of the bin.

7. The container of claim 6 wherein such ones of the vertically extending grooves as are provided in the left side wall are located directly opposite such ones of the vertically extending grooves as are provided in the right side wall so that the removable divider can be installed with the opposite ends in opposite ones of the grooves, with the divider extending in a plane that substantially parallels the front and rear walls.

8. The container of claim 7 additionally including slot-like holes formed through the bottom wall that substantially align with at least selected ones of the vertically extending grooves so as to reside within said plane for receiving depending projections that are provided on a bottom portion of the removable divider.

9. The container of claim 6 wherein the vertically extending grooves open through the top surfaces of the left and right side walls.

10. The container of claim 6 additionally including means for being installed atop the front and rear walls of the container and atop the left and right side walls of the container for extending the height of the front and rear walls and the left and right side walls of the container, and for providing vertically extending extensions of the vertically extending grooves in the left and right side walls, and wherein the removable divider is configured to engage the vertically extending extensions of the vertically extending grooves.

11. The container of claim 1 wherein the left and right side walls and the rear wall 1) extend substantially vertically, 2) define top surfaces at upper ends thereof that extend in a substantially common horizontally extending plane, and 3) define bottom surfaces at lower ends thereof that extend in another substantially common horizontally extending plane, and wherein the container is stackable with other identically configured containers with one of the other identically configured containers having bottom surfaces thereof engaging atop the top surfaces of the container, and with another of the identically configured containers having top surfaces thereof engaging the bottom surfaces of the container.

12. The container of claim 11 additionally including means for enabling the container to securely connect with the one of the identically configured containers and with the another of the identically configured containers when the one of the identically configured containers has the bottom surfaces thereof engaging the top surfaces of the container, and when the another of the identically configured containers has the top surfaces thereof engaging the bottom surfaces of the container.

13. The container of claim 12 wherein the front and rear walls, the left and right side walls, the bottom wall and the means are formed as a unitary structure molded from plastics material.

14. The container of claim 12 wherein the means includes a plurality of upwardly extending projections supported by selected ones of the left and right side walls and the rear wall, and includes a plurality of downwardly opening cavities supported by the selected ones of the left and right side walls and the rear wall.

15. The container of claim 1 additionally including means for being defined near front end regions of the left and right side walls for removably connecting with means for extending forwardly from near the front end regions of the left and right side walls for supporting opposite end regions of a pivotal door, and a pivotal door having opposite end regions that are pivotally connectable with the means for extending forwardly from the left and right side walls, with the pivotal door being pivotally movable between a position overlying a relatively large portion of the front opening to a position overlying a lesser portion of the front opening.

16. The container of claim 15 wherein the pivotal door includes means for supporting a sign.

17. The container of claim 16 wherein the pivotal door has a transparent portion, and the means for supporting a sign is configured to support said sign at a location behind the transparent portion for being viewed through the transparent portion.

18. The container of claim 15 wherein the means for extending forwardly from near the front end regions of the left and right side walls included extender members that are pivotally connected to opposite end regions of the pivotal door in a manner that permits the door to pivot about a substantially horizontally extending axis that substantially parallels the front wall at a location near upper regions of the front wall.

19. The container of claim 18 wherein the extender members include a left extender configured to connect with and extend forwardly from near the left side wall, and a right extender configured to connect with and extend forwardly from near the right side wall.

20. The container of claim 19 wherein the container is formed as a unitary structure molded from plastics material, the door is formed as a unitary structure molded from plastics material, and the left and right extenders each are molded from plastics material.

21. The container of claim 18 wherein the pivotal door has a vertically extending length that permits the door to depend from said axis to a position wherein the door overlies a majority of but not all of the front opening.

22. The container of claim 18 wherein the pivotal door has a vertically extending length that permits the door to depend from said axis to a position beneath the front wall of the container wherein the door overlies substantially all of the front opening of the container and a portion of a front opening of an identical container positioned directly beneath the container in a manner such that the front wall of the identical container aligns with the front wall of the container, and the front opening of the identical container is located directly beneath the front opening of the container.

23. A stackable one-piece container for defining a front-accessible bin for displaying tubular articles therein, comprising:

a) left and right upstanding, generally rectangular side walls that are 1) joined at rear end regions thereof by a transversely extending, upstanding, generally rectangular rear wall, and 2) joined at front end regions thereof by a transversely extending, upstanding, generally rectangular front wall;

b) a bottom wall extending between the front and rear walls so as to define an inner surface that joins substantially at right angles with inner surfaces of the front and rear walls, and extends between inner surfaces of the upstanding left and right walls in a concave manner so as to cooperate with the inner surfaces of the left and right side walls to define a bin of U-shaped cross-section that is substantially symmetrical about an imaginary plane that parallels the upstanding left and right side walls at a location mid-way therebetween, wherein the U-shaped cross-section is substantially uniform from the back of the bin to the front of the bin, has its greatest depth where the imaginary plane joins with the front and rear walls, and has its shallowest depth where the inner surface joins with the inner surfaces of the left and right side walls;

c) with means being defined in upper and lower regions of the left and right side walls of said container for mating with a lower container and an upper container that are configured identically to said container to make it possible for said container to be stacked and supported atop the lower container, with the upper container being stacked and supported atop said container;

d) a substantially U-shaped opening defined by the front wall for providing access to said bin in a zone that extends vertically from near the bottom wall to near the upper regions of the side walls, and horizontally from near the left side wall to near the right side wall; and, e) with upstanding rib formations underlying, connecting with, strengthening and rigidifying the bottom wall at locations between the lower regions of the left and right side walls.

24. In combination, the container of claim 23 and a left extender configured to be attached to the upper regions of the left side wall, a right extender configured to be attached to the upper regions of the right side wall, and a door configured to overlie at least a portion of the U-shaped opening of the front wall, wherein the left and right extenders are adapted to pivotally connect with opposite end regions of the door to mount the door to overlie at least said portion of the U-shaped opening of the front wall and to pivot about an axis spaced forwardly from an upper paft of the front wall.

25. The combination of claim 24 wherein the pivotal door includes means for supporting a sign.

26. The combination of claim 25 wherein the pivotal door has a transparent portion, and the means for supporting a sign is configured to support said sign at a location behind the transparent portion for being viewed through the transparent portion.

27. The combination of claim 24 wherein the door has a vertically extending length that permits the door to depend from said axis to a position beneath the front wall of the container wherein the door overlies substantially all of the front opening of the container and is capable of overlying an upper portion of a front opening of an identical container positioned directly beneath the container in a manner such that the front wall of the identical container aligns with the front wall of the container, and the front opening of the identical container is located directly beneath the front opening of the container.

28. The container of claim 23 wherein the front and rear walls, the left and right side walls, and the bottom wall are formed as a unitary structure molded from plastics material.

29. The container of claim 28 wherein substantially vertically extending grooves that open into the bin are provided in the left and right side walls for receiving opposite ends of a removable divider adapted to segregate a rear portion of the bin from a front portion of the bin.

30. The container of claim 29 wherein such ones of the vertically extending grooves as are provided in the left side wall are located directly opposite such ones of the vertically extending grooves as are provided in the right side wall so that the removable divider can be installed with the opposite ends in opposite ones of the grooves, with the divider extending in a plane that substantially parallels the front and rear walls.

31. The container of claim 30 additionally including slot-like holes formed through the bottom wall that substantially align with at least selected ones of the vertically extending grooves so as to reside within said plane for receiving depending projections that are provided on a bottom portion of the removable divider.

32. The container of claim 29 additionally including means for being installed atop the front and rear walls of the container and atop the left and right side walls of the container for extending the height of the front and rear walls and the left and right side walls of the container, and for providing vertically extending extensions of the vertically extending grooves in the left and right side walls, and wherein the removable divider is configured to engage the vertically extending extensions of the vertically extending grooves.

33. An array of identical bins stacked one atop another including a middle bin situated between an upper bin and a lower bin, wherein:

a) each of the upper, middle and lower bins has a top, a bottom, a front, a rear, opposed sides, a generally U-shaped interior that extends from the front to the rear with the greatest depth of the U-shaped interior being located substantially midway between the opposed sides, and a generally U-shaped front opening that extends nearly the full distance between the opposed sides and nearly the full depth of the generally U-shaped interior to provide substantially unobstructed access to the generally U-shaped interior;

b) a selected adjacent pair of the upper, middle and lower bins is provided with a first door that: is connected to the uppermost of the adjacent pair of bins for pivoting about a substantially horizontally extending first axis located near but spaced forwardly from the top of the uppermost of the adjacent pair of bins, with the first door being configured to depend from the first axis across the U-shaped opening of the uppermost of the adjacent pair of bins and across only upper portions of the U-shaped opening of the lowermost of the adjacent pair of bins;

c) a remaining one of the upper, middle and lower bins is provided with a second door that is connected to the remaining one of the bins for pivoting about a substantially horizontally extending second axis located near but spaced forwardly from the top of the remaining one of the bins, with the second door being configured to depend from the second axis across only upper portions of the U-shaped opening of the remaining one of the bins;

d) the first door is adapted to carry a first sign identifying contents of the adjacent pair of bins; and, e) the second door is adapted to carry a second sign identifying contents of the remaining one of the bins.

34. The array of claim 33 wherein the first and second doors each have a substantially transparent front, with the first door being adapted to carry the first sign at a location behind the transparent front of the first door, and with the second door being adapted to carry the second sign at a location behind the transparent front of the second door.

35. The array of claim 34 wherein the first and second doors have tab-like projections located behind the transparent fronts of the first and second doors for extending behind the first and second signs to hold the first and second signs against the transparent fronts of the first and second doors, respectively.

36. The array of claim 33 additionally including means for releasably connecting the first and second doors to the uppermost of the adjacent pair of bins and to the remaining one of the bins, respectively.

37. The array of claim 34 wherein the means includes left and right extenders for being removably connected, respectively, to left and right portions of the fronts of the uppermost of the adjacent pair of bins and to the remaining one of the bins.

38. The array of claim 35 wherein the means additionally includes left and right projecting formations carried on the fronts of all of the upper, middle and lower bins that are configured to be engaged by the left and right extenders to enable the first and second doors to be releasably connected to different ones of the upper, middle and lower bins.

39. The array of claim 33 additionally including means for being connected to at least a selected one of the upper, middle and lower bins and adapted for connection to a wall situated behind the array of bins.

40. The array of claim 39 wherein at least one adjacent pair of the upper, middle and lower bins are connected by at least one vertically extending formation of one of the pair that extends into an opening defined by the other of the pair, and wherein the means includes a thin bracket adapted for connection to the wall and defining a hole through which the vertically extending formation extends to connect the bracket to the pair.

41. The array of claim 33 wherein adjacent pairs of the upper, middle and lower bins are connected by tab-like formations that extend upwardly from the middle and lower bins and are received in openings that are defined by the upper and middle bins, and wherein a bracket is provided for connecting the array to other structure, with the bracket having a hole through which at least one of the tab-like formations extends to couple the bracket to the array.

42. The array of claim 41 wherein the upper and middle bins have recessed bottom portions configured to receive portions of the bracket at locations adjacent the at least one of the tab-like formations.

43. A method of displaying cylindrical articles of first and second diameters wherein the first diameter is greater than the second diameter, comprising the steps of:

a) providing an array of identical bins that are stacked one atop another including a middle bin situated between an upper bin and a lower bin, wherein:

i) each of the upper, middle and lower bins has a top, a bottom, a front, a rear, opposed sides, a generally U-shaped interior that extends from the front to the rear with the greatest depth of the U-shaped interior being located substantially midway between the opposed sides, and a generally U-shaped front opening that extends nearly the full distance between the opposed sides and nearly the full depth of the generally U-shaped interior to provide substantially unobstructed access to the generally U-shaped interior;

ii) a selected adjacent pair of the upper, middle and lower bins is provided with a first door that is connected to the uppermost of the adjacent pair of bins for pivoting about a substantially horizontally extending first axis located near but spaced forwardly from the top of the uppermost of the adjacent pair of bins, with the first door being configured to depend from the first axis across the U-shaped opening of the uppermost of the adjacent pair of bins and across only upper portions of the U-shaped opening of the lowermost of the adjacent pair of bins;

iii) a remaining one of the upper, middle and lower bins is provided with a second door that is connected to the remaining one of the bins for pivoting about a substantially horizontally extending second axis located near but spaced forwardly from the top of the remaining one of the bins, with the second door being configured to depend from the second axis across only upper portions of the U-shaped opening of the remaining one of the bins;

iv) the first door is adapted to carry a first sign identifying contents of the adjacent pair of bins; and, v) the second door is adapted to carry a second sign identifying contents of the remaining one of the bins;

b) arranging the articles of the first diameter in the adjacent pair of bins with a first sign on the first door identifying the articles of the first diameter; and, c) arranging the articles of the second diameter in the remaining one of the bins with a second sign on the second door identifying the articles of the second diameter.

44. The method of claim 43 wherein the step of providing includes the step of forming the first and second doors formed from transparent material, and wherein the steps of arranging includes forming the first and second signs from material that is at least partially transparent, whereby the articles of the first and second diameters are viewable through the doors and through the signs when arranged in the bins.

45. The method of claim 44 additionally including the steps of providing all of the bins of the array with connectors that permit the first and second signs to be releasably attached thereto.

* * * * *